US009593860B1

(12) United States Patent
Robinson

(10) Patent No.: US 9,593,860 B1
(45) Date of Patent: Mar. 14, 2017

(54) WATER RECYCLER FOR A HUMIDIFIER

(71) Applicant: James F. Robinson, Chestermere (CA)

(72) Inventor: James F. Robinson, Chestermere (CA)

( * ) Notice: Subject to any disclaimer, the term of this patent is extended or adjusted under 35 U.S.C. 154(b) by 8 days.

(21) Appl. No.: 14/522,155

(22) Filed: Oct. 23, 2014

Related U.S. Application Data

(60) Provisional application No. 61/894,597, filed on Oct. 23, 2013.

(51) Int. Cl.
*B04B 11/04* (2006.01)
*F24F 11/00* (2006.01)
*F24F 6/00* (2006.01)

(52) U.S. Cl.
CPC ..... *F24F 11/0008* (2013.01); *F24F 6/00* (2013.01); *F24F 2006/008* (2013.01); *Y10T 137/7323* (2015.04); *Y10T 137/85986* (2015.04); *Y10T 137/86027* (2015.04); *Y10T 137/86107* (2015.04)

(58) Field of Classification Search
CPC ..... Y10T 137/85978; Y10T 137/85986; Y10T 137/86027; Y10T 137/86107; F24F 2006/008; F24F 11/0008; F24F 6/04; F24F 6/00; G05D 22/02; B60R 7/00; B60R 11/02; B60R 2011/005; B60R 2011/0029
USPC ..... 137/395, 398, 565.01, 565.11, 565.16, 137/565.26; 417/14, 18–19, 36, 40; 261/27, 70
See application file for complete search history.

(56) References Cited

U.S. PATENT DOCUMENTS

| | | | | |
|---|---|---|---|---|
| 1,329,252 | A * | 1/1920 | Millard | F02M 25/0225 261/121.1 |
| 2,347,905 | A | 5/1944 | Hait | |
| 3,759,048 | A * | 9/1973 | Cochran | 62/73 |
| 4,080,104 | A * | 3/1978 | Brown, Jr. | 417/17 |
| 5,108,591 | A * | 4/1992 | Hagan | 210/104 |
| 5,203,677 | A * | 4/1993 | Lix et al. | 417/12 |
| 5,243,719 | A | 9/1993 | McDonald et al. | |
| 5,966,953 | A * | 10/1999 | Murr | A01K 1/0082 261/27 |
| 6,322,326 | B1 * | 11/2001 | Davis et al. | 417/40 |
| 6,375,430 | B1 * | 4/2002 | Eckert et al. | 417/40 |
| 7,520,736 | B2 * | 4/2009 | Pohler | 417/423.14 |
| 7,895,849 | B2 * | 3/2011 | Chiu | 62/150 |
| 8,375,481 | B1 | 2/2013 | Gibbins | |
| 8,523,532 | B1 * | 9/2013 | Pohler | 417/40 |
| 2002/0070465 | A1 * | 6/2002 | Harvel | F24F 6/04 261/36.1 |
| 2007/0174959 | A1 | 8/2007 | Sanders et al. | |
| 2011/0067769 | A1 | 3/2011 | Stimpson | |
| 2012/0251333 | A1 | 10/2012 | Irwin et al. | |
| 2012/0260417 | A1 | 10/2012 | LeBlanc | |

(Continued)

*Primary Examiner* — Craig J Price
(74) *Attorney, Agent, or Firm* — Robert C. Montgomery; Montgomery Patent & Design L.P.

(57) ABSTRACT

A water recycler is designed to recycle waste water from a drip-type humidifying system. A water reservoir is provided with an opening to accept a drain line from the existing humidifier system. Additional fresh water is added into the reservoir to maintain a preset level via a float valve. The system is further provided with an internal pump which is activated by an existing furnace switch. The pump draws water from the reservoir and supplies it to the humidifier for reuse. As water is consumed by the humidifier, it is replenished by the fresh water system to ensure an adequate supply of water at all times.

17 Claims, 4 Drawing Sheets

(56) References Cited

U.S. PATENT DOCUMENTS

| | | | |
|---|---|---|---|
| 2012/0261339 | A1 | 10/2012 | Brummer |
| 2013/0019561 | A1 | 1/2013 | Andras |

* cited by examiner

WATER RECYCLER FOR A HUMIDIFIER

RELATED APPLICATIONS

The present invention is a continuation-in-part of, was first described in, and claims the benefit of U.S. Provisional Application No. 61/894,597, filed Oct. 23, 2013, the entire disclosures of which are incorporated herein by reference.

FIELD OF THE INVENTION

The present invention relates to a cover configured to be placed over a water shut-off valve and enable actuation of the shut-off valve while the cover is in place.

BACKGROUND OF THE INVENTION

Dry air is one (1) of the major causes of nose bleeds, respiratory infections, colds, and flu. Proper humidity in one's home can increase the indoor air quality of your home or office, and combat the negative effects of dry air and dehydration. Dry air is often more prevalent in winter months when heating systems operate, as the heat tends to dry air out. Many combat such dry air with central humidifiers attached to their HVAC systems. While such systems do work, they tend to waste large quantities of freshwater which is simply routed down the drain. This water not only represents money going down the drain, but is also especially disconcerting during times of water shortages, and increased emphasis on ecologically friendly products. Accordingly, there exists a need for a means by which excess drain water from central humidifying systems can be easily recycled in an effort to address the problems as described above. The development of the present invention fulfills this need.

SUMMARY OF THE INVENTION

As such, a need was observed, where a reservoir is disposed close to a humidifier to recycle the waste water. The reservoir preferably is a rectangular enclosure having an interior, a means to receive waste water from the humidifier, a means to transfer water stored therein back to the humidifier, and a control means.

An object of the present invention is to provide a humidifier hose that transfers the waste water from the humidifier to an inlet fitting of a top surface of the reservoir.

Another object of the present invention is to provide a pumping mechanism stored within the reservoir to transfer the stored water within the reservoir, through a pump hose that is routed through the reservoir for connection to a water intake of the humidifier. The pump is controlled by the control means, which is preferably a pump relay controlled by a power switch and mounted on an external surface of the reservoir.

Yet another object of the present invention is to provide a float valve connected to one of the sidewalls of the reservoir for providing automatic levelling of the water within the reservoir, mainly to ensure that the pumping mechanism is submerged at all times. Make-up water is transferred from a water source through a fill hose and is regulated via the float valve to fill the reservoir as needed.

Another object of the present invention is to provide an overflow fitting connected to a sidewall of the reservoir, above the location of the float valve, to provide a way to drain the enclosure as necessary.

Yet another object of the present invention is to provide an access port to allow cleaning, manual filling, or manual draining of the reservoir as needed.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
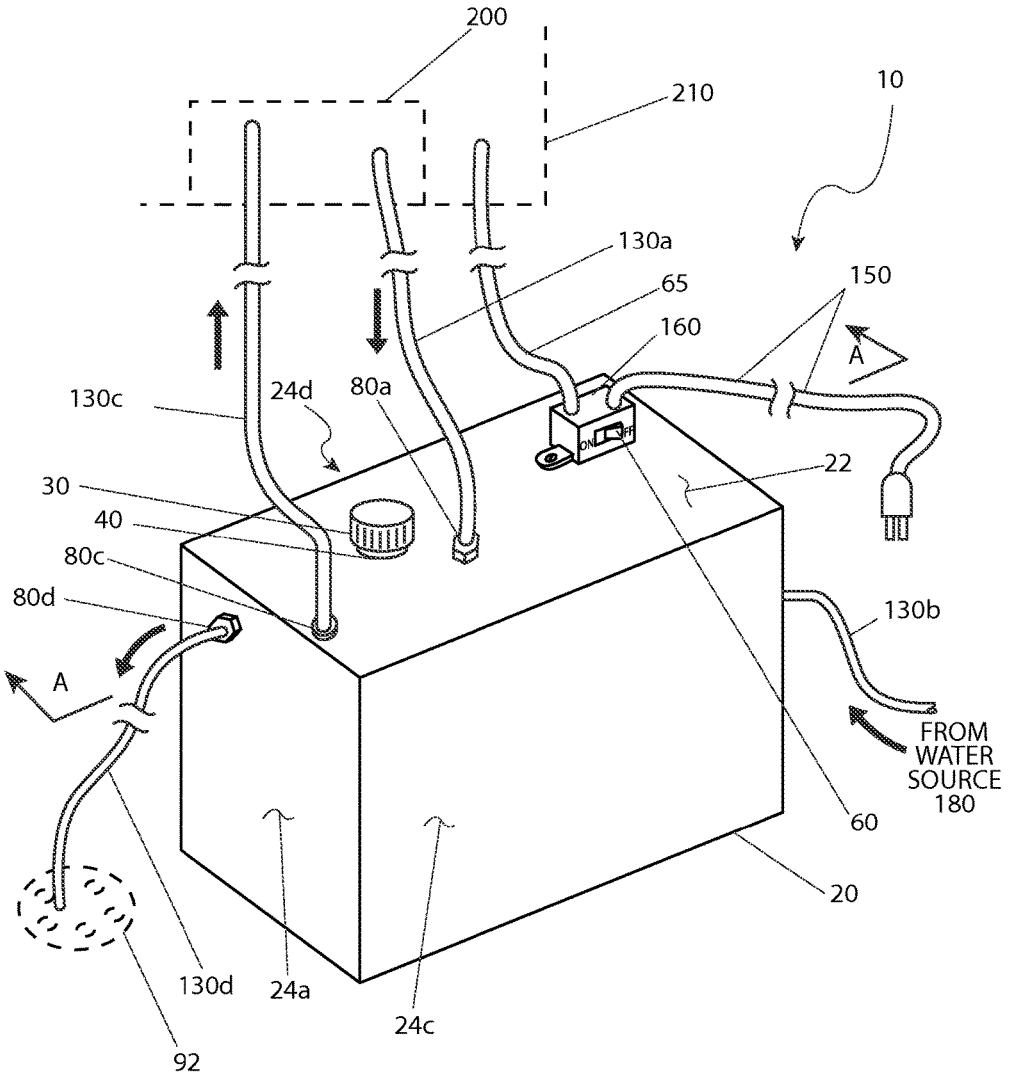
FIG. 1 is a perspective view of a water recycler 10, according to a preferred embodiment of the present invention.

10 water recycler
20 reservoir
22 top surface
23 bottom surface
24*a* first side surface
24*b* second side surface
24*c* front side surface
24*d* rear side surface
30 screw cap
40 fill nipple
50 float valve
55 float
60 power switch
65 wiring
80*a* first fitting
80*b* second fitting
80*c* third fitting
80*d* fourth fitting
80*e* fifth fitting
92 drain
100 pump
110 pump-inlet port
120 pump-outlet port
130*a* first hose
130*b* second hose
130*c* third hose
130*d* fourth hose
150 power cord
155 power source
160 pump relay assembly
170 solenoid valve
175 control switch assembly
180 water source
200 humidifier
210 furnace
300 water

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a water recycler for a furnace humidifier (herein referred to as the "device") 10, which provides a means to collect emitted drain water from an existing humidifier 200, retain it in a reservoir 20, and directed it back into the humidifier 200 via a pump 100.

Figure 2:
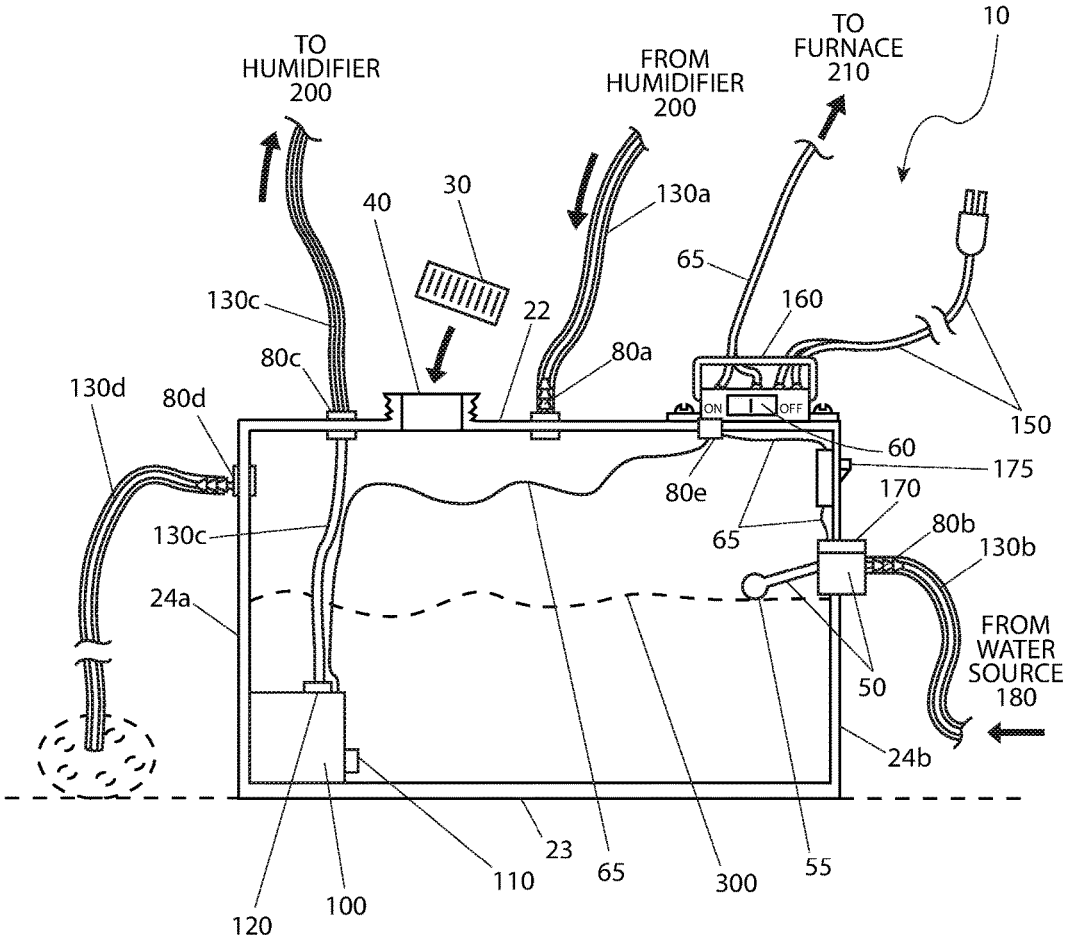
FIG. 2 is a sectional view of the water recycler 10 taken along section line A-A (see FIG. 1), according to a preferred embodiment of the present invention; and, FIG. 3 is an electrical block diagram of the water recycler 10, according to a preferred embodiment of the present invention; and, FIG. 4 is a sectional view of the water recycler 10 taken along section line A-A (see FIG. 1), according to an alternate embodiment of the present invention.

Referring now to FIGS. 1 and 2, perspective and sectional views of the device 10, in accordance with the preferred embodiment of the present invention, are disclosed. The device 10 is used to recycle waste water 300 from an existing drip-type humidifying system 200. The device 10 utilizes a reservoir 20 to collect and recycle waste water 300 emitted from the humidifier portion 200 of a furnace 200.

The reservoir 20 preferably comprises a rectangular vessel suitable for holding liquid water 300 and is preferably fabricated from a polymer material; however, other materials and configurations may be used without deviating from the teachings of the device 10. The reservoir 20 further comprises a top surface 22, a bottom surface 23, a first side surface 24*a*, an opposing second side surface 24*b*, a front side surface 24*c*, and an opposing rear side surface 24*d*. A first fitting 80*a*, preferably being a panel-mounted barbed fitting, is connected to a first hose 130*a* and installed upon an inlet aperture located on the top surface 22 of the reservoir 20. A first hose 130 has a first end attached to the first fitting 80*a* and a second end adapted to be attached to a drain of a humidifier 200, through which waste water 300 from the humidifier 200 enters the reservoir 20. The inlet aperture leads to an interior cavity portion of the reservoir 20 and enables the drain water 300 from the humidifier 200 to be collected in the reservoir 20. This drain water 300 would normally be disposed of with the typical set-up of a drip-type humidifier system 200; however, the waste water 300 is redirected into the device 10 via the first fitting 80*a* and first hose 130*a* portions for recycling.

Additionally, fresh make-up water 300 is supplied to the device 10 from a pressurized water source 180 via a second hose 130*b* being attached to the reservoir 20 using a barbed-type second fitting 80*b* and a float valve 50, being disposed upon a second side surface 24*b* of the reservoir 20. The float valve 50 maintains a consistent level of water 300 within the reservoir 20. The float valve 50 is preferably a mechanical type capable of permitting or obstructing a flow of water 300 and having a pivoting float 55 type actuator; however, other styles and configurations of valving may be utilized without deviating from the teachings of the device 10. The float 55 exhibits a specific buoyancy within the water 300 of the reservoir 20. As the level of the water 300 changes, the relative position of the float 55 with respect to the float valve 50 changes. When a pre-determined level of depletion of recycled water is obtained within the reservoir 20, the float 55 position conditions the float valve 50 to permit fresh water 300 to flow into the reservoir 20 until a level of the water 300 is restored, whereby the float valve 50 obstructs the inflow of the water 300. The float valve 50 also ensures that the pump 100 is submerged at all times and that a consistent and adequate supply of water 300 is provided to the humidifier 200 for proper operation.

Waste water 300 from the humidifier 200 and make-up water 300 from the water source 180 enters the reservoir 20 through first hose 130*a* and second hose 130*b* portions, respectively. The water 300 is subsequently supplied to the humidifier 200 by an internal submersible pump 100 using a third hose 130*c*. The pump 100 is housed within the reservoir 20 and is preferably an electrically powered positive displacement or diaphragm-type pump; however, other pumps 100 may be utilized without deviating from the teachings of the device 10. The pump 100 is provided with a pump-inlet port 110 and a pump-outlet port 120. The pump 100 is to be submerged in the water 300 contained within the reservoir 20, receives the water 300 through the pump-inlet port 110 and expels the water 300 under pressure out of the pump-outlet port 120. The third hose 130*c* is connected to the pump-outlet 120, which is routed from the pump-outlet 120 through a sealing grommet-like third fitting 80*c* which enables sealed penetration of the top surface portion 22 of the reservoir 20. The third hose 130*c* is in turn routed and adapted to be placed into fluid communication with a water-intake portion of the existing humidifier 200, thereby replacing the original water supply hose previously connected to the humidifier 200.

The pump 100 is placed into electrical communication with an external electrical power source 155 via a pump relay assembly 160, a power switch 60, and an extending power cord 150, each being arranged in a series manner. The power cord 150 is to be plugged into the electrical power source 155, which is envisioned to be a standard 110-volt electrical outlet (also see FIG. 3).

A top surface 22 of the reservoir 20 is provided with an access aperture, such as a fill nipple 40 in fluid communication with the reservoir 20 interior. A cap 30 is removably attached to the fill nipple 40 to provide access into the interior of the reservoir 20 for purposes of cleaning, maintenance, and the like.

The reservoir 20 also provides a means to dispose of overflow water 300 in an event of a failure of the float valve 50. A fourth fitting 80*d*, preferably being a panel-mount barbed fitting, is installed upon an upper portion of a first side surface 24*a* of the reservoir 20. A fourth hose 130*d* has a first end attachable to the fourth fitting 80*d* and a second end adapted to be attached to an existing drain system 92 such as a floor drain or the like, in order to conduct any overflow water 300. This ensures that in the event the float valve 50 malfunctions, or a surge of water 300 is received, the excess water 300 has a means to exit and drain from the reservoir 20. Furthermore, during times when the device 10 is shut off for some reason, the fourth fitting 80*d* and fourth hose 130*d* provide disposal of the waste water 300 from the humidifier 200.

Figure 3:
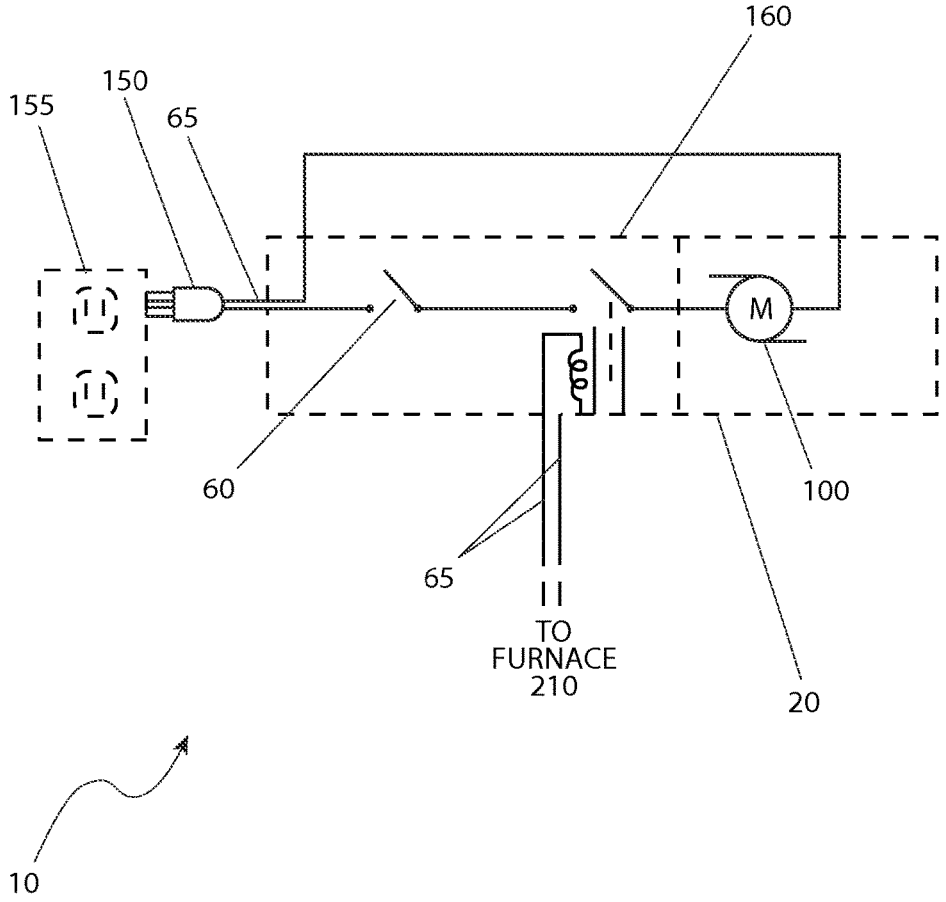

Referring now to FIG. 3, an electrical block diagram of the device 10, according to a preferred embodiment of the present invention, is disclosed. The device 10 is energized by plugging the power cord 150 into a power source 155, such as an outlet, and turning the power switch 60 to an "on" position. Electrical power is then supplied to the pump relay assembly 160 which is disposed upon the top surface 22 of the device 10. The pump relay assembly 160 is adapted to be placed in electrical connection with particular wiring portions 65 of the furnace 210, such as a fan or other component, which provides an output current during the times that the furnace 210 is activated. The current from the furnace

210 is utilized to switch the pump relay assembly 160 causing power from the power source 155 to energize the pump 100, thereby causing water 300 to be pumped through the second hose 130*b* to supply water 300 to the humidifier 200.

The pump relay assembly 160 provides a means to electrically connect the pump 100 to the electrical power source 155. The pump relay assembly 160 further includes a power switch 60 preferably being an on/off toggle-type switch. When in an "on" position, the power switch 60 provides a current to the pump relay assembly 160. The pump relay assembly 160 in turn supplies electrical power to the pump 100 upon receiving a switching current from the existing furnace 210 via an interconnecting wire 65 having a grommet-style fifth fitting 80*e* which acts to seal the wire 65 as it exits the top surface 22.

Figure 4:
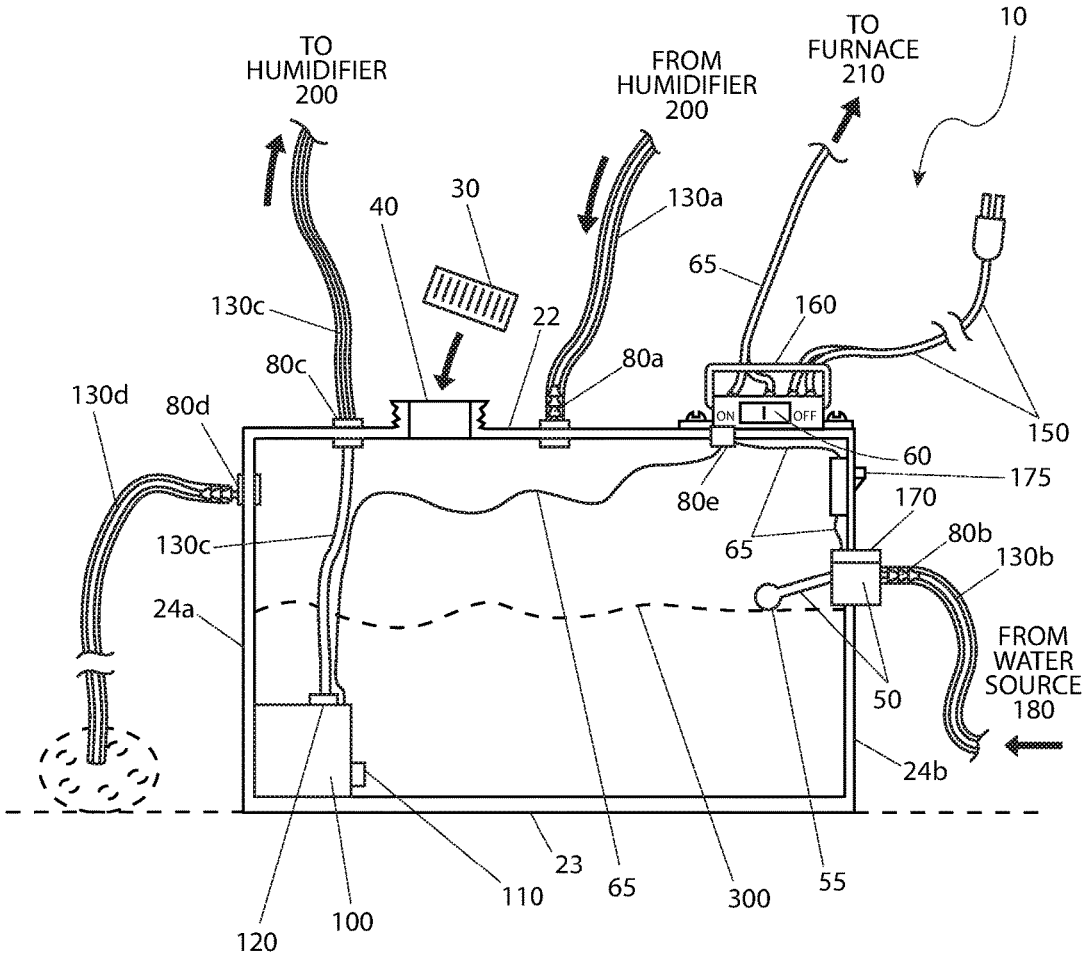

It is envisioned that other styles and configurations of the present invention can be easily incorporated into the teachings of the present invention, and only one particular configuration shall be shown and described for purposes of clarity and disclosure and not by way of limitation of scope. Such an alternate embodiment is illustrated in FIG. 4. In this embodiment, the float 55 is in mechanical communication with a solenoid valve 170. A control switch assembly 170 is then disposed between the electrical relay 160, the pump 100, and the solenoid valve. In certain embodiments, the control switch assembly 170 is a toggle switch.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring a model of the device 10; connecting a supply of fresh water 300 to the reservoir 20 by connecting the second hose 130*b* to a water source 180 at a distal end, and to the second fitting portion 80*b* of the reservoir 20 at the proximal end; allowing the float valve 50 to fill the reservoir 20 with water 300 enough to submerge the pump 100; routing and connecting the distal end of the fourth hose 130*d* to a drain 92, and connecting the proximal end of the fourth hose 130*d* to the fourth fitting portion 80*d* of the reservoir 20; routing and connecting a distal end of the first hose 130*a* to the drain tube of an existing humidifier 200 and the proximal end of the first hose 130*a* to the first fitting portion 80*a* of the reservoir 20; routing and connecting the third hose 130*c* to a water intake portion of the humidifier 200; ensuring that the power switch 60 is placed in an 'off' position; connecting particular wiring 65 from the furnace 210 such as a fan or the like, which provides an output current during the times that the furnace 210 is activated, to the pump relay assembly 160; plugging the power cord 150 into an electrical power source 155 such as a duplex outlet; placing the power switch 60 in an 'on' position; operating the humidifier 200 in a normal manner; allowing the humidifier 200 to provide excess waste water 300 to the reservoir 20 to be recycled through the device 10; allowing the pump 100 to supply water to the humidifier 200 when the furnace 210 is in operation; selecting the 'off' position of the power switch 60 when it is no longer desired to employ the device 10; allowing the disposal of the waste water 300 from the humidifier 200 through the fourth hose 130*d* to a drain 92 during times when the device 10 is shut off; and, benefiting from the conservation and recycling of waste water 300 from a humidifier 200 afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A water recycler device comprising:

a reservoir, comprising:

an inlet aperture located at a top portion of said reservoir; and, a hose port located at a top portion of said reservoir;

a float assembly disposed on a first location on a sidewall of said reservoir, comprising:

a solenoid valve;

a mechanical float in mechanical connection with said solenoid valve; and, a fill hose adapted to place said float assembly in fluid communication with a fresh water supply;

an electrical relay switch disposed on a top surface of said reservoir and adapted to be in electrical communication with a power source;

a pump placed into electrical communication with said electrical relay switch and located within an interior of said reservoir, comprising:

a pumping mechanism;

a pump inlet in connection with said pumping mechanism; and, a pump outlet in connection with said pumping mechanism;

a humidifier hose, having a first end connected to said inlet aperture and a second end adapted to be connected to a drain of a humidifier; and, a pump hose, having a first end connected to said pump outlet and a second end adapted to be connected to a water intake of said humidifier;

wherein said humidifier hose adaptably transfers waste water from said humidifier within reservoir; and, wherein said pump hose adaptably transfers water from within said reservoir to said humidifier.

2. The device recited in claim 1, wherein said reservoir is further provided with an access aperture.

3. The device recited in claim 2, further comprising a first threaded circular flange extending from a perimeter edge of said access aperture.

4. The device recited in claim 3, further comprising:

a cap;

a second threaded circular flange extending perpendicularly from a bottom surface of said cap; and, wherein said first threaded flange receives said second threaded flange to secure said cap onto said access aperture.

5. The device recited in claim 1, wherein said float valve is positioned so as to maintain a level of water capable of keeping said pumping mechanism continually submerged.

6. The device recited in claim 1, further comprising a control switch assembly disposed between said electrical relay switch, said pump, and said solenoid valve.

7. The device recited in claim 6, wherein said control switch assembly is provided with a toggle switch.

8. The device recited in claim 1, further comprising an overflow fitting disposed on a second location on a sidewall of said reservoir and an overflow hose adapted for connecting said overflow fitting to an ancillary drain.

9. The device recited in claim 8, wherein said second location is disposed between said first location and a top wall of said reservoir.

10. A water recycler device comprising:

a reservoir, comprising:

an inlet aperture located at a top portion of said reservoir; and, a hose port located at a top portion of said reservoir;

an electrical relay switch disposed on a top surface of said reservoir and adapted to be in electrical communication with a power source;

a pump placed into electrical communication with said electrical relay switch and located within an interior of said reservoir, comprising:

a pumping mechanism;

a pump inlet in connection with said pumping mechanism; and, a pump outlet in connection with said pumping mechanism;

a float assembly disposed on a first location on a sidewall of said reservoir, comprising:

a solenoid valve;

a mechanical float in mechanical connection with said solenoid valve; and, a fill hose adapted to place said float assembly in fluid communication with a fresh water supply;

an overflow fitting disposed on a second location on a sidewall of said reservoir;

an overflow hose adapted for connecting said overflow fitting to an ancillary drain;

a humidifier hose, having a first end connected to said inlet aperture and a second end adapted to be connected to a drain of a humidifier; and, a pump hose, having a first end connected to said pump outlet and a second end adapted to be connected to a water intake of said humidifier;

wherein said humidifier hose adaptably transfers waste water from said humidifier within reservoir; and, wherein said pump hose adaptably transfers water from within said reservoir to said humidifier.

11. The device recited in claim 10, wherein said reservoir is further provided with an access aperture.

12. The device recited in claim 11, further comprising a first threaded circular flange extending from a perimeter edge of said access aperture.

13. The device recited in claim 12, further comprising:

a cap;

a second threaded circular flange extending perpendicularly from a bottom surface of said cap; and, wherein said first threaded flange receives said second threaded flange to secure said cap onto said access aperture.

14. The device recited in claim 10, wherein said mechanical float is positioned so as to maintain a level of water capable of keeping said pumping mechanism continually submerged.

15. The device recited in claim 14, further comprising a control switch assembly disposed between said electrical relay switch, said pump, and said solenoid valve.

16. The device recited in claim 15, wherein said control switch assembly is provided with a toggle switch.

17. The device recited in claim 10, wherein said second location is disposed between said first location and a top wall of said reservoir.

* * * * *